US006390519B1

(12) United States Patent
Dreisbach et al.

(10) Patent No.: US 6,390,519 B1
(45) Date of Patent: May 21, 2002

(54) ROTATABLE SEAL

(75) Inventors: Richard C. Dreisbach; Carlos M. Pinho, both of North Arlington, NJ (US)

(73) Assignee: E. J. Brooks Company, Livingston, NJ (US)

( * ) Notice: Subject to any disclaimer, the term of this patent is extended or adjusted under 35 U.S.C. 154(b) by 22 days.

(21) Appl. No.: 09/590,059

(22) Filed: Jun. 8, 2000

(51) Int. Cl.[7] ..... B65D 27/30

(52) U.S. Cl. ..... 292/307 R; 242/388.1

(58) Field of Search ..... 292/307 R, 320, 292/319, 326; 242/388.1, 388.6

(56) References Cited

U.S. PATENT DOCUMENTS

| | | | | |
|---|---|---|---|---|
| 210,641 | A | * 12/1878 | Smith et al. | 292/307 R |
| 4,978,026 | A | * 12/1990 | Gnoinski | 220/214 |
| 5,180,200 | A | * 1/1993 | Georgopoulos et al. | 292/326 |
| 5,402,958 | A | * 4/1995 | Mahaney | 242/388.1 |
| 5,419,599 | A | 5/1995 | Georgopoulos | |
| 6,000,736 | A | 12/1999 | Leon et al. | |
| 6,007,121 | A | 12/1999 | Dreisbach et al. | |

FOREIGN PATENT DOCUMENTS

EP 0423831 A2 * 4/1991

* cited by examiner

*Primary Examiner*—Brian L. Johnson
*Assistant Examiner*—Daniel Yeagley
(74) *Attorney, Agent, or Firm*—Carella Byrne Bain Gilfillan; John G. Gilfillan, III; William Squire

(57) ABSTRACT

A housing has a rotor receiving chamber with filament receiving bores lying in a plane normal to the rotor axis of rotation, a rotor being rotatably received in the chamber. The rotor and housing have complementary locking shoulders for axially locking the rotor in the chamber. The rotor has a pair of filament receiving bores aligned with the housing filament receiving bores. The rotor has an annular rib in the plane of the bores defining upper and lower rotor sections. The locking shoulders are in the lower section of the rotor and are located between the plane and the closed end of the chamber, at which end the rotor and housing have a complementary ratchet and pawl mechanism for allowing only one way rotation of the rotor relative to the housing for securing the filament to the rotor. The rib guides the filament wrapped about the rotor into sub-chambers formed by the rib to minimize blockage of the rotor bores by the locking and wrapping of one filament end to the rotor in an unlocked shipping state of the seal. This permits the free end of the filament to be secured to the other bore in the rotor at the time of sealing of the seal to an article.

12 Claims, 6 Drawing Sheets

ROTATABLE SEAL

CROSS REFERENCE TO RELATED PATENTS

Of interest are commonly owned U.S. Pat. Nos. 5,180,200, 5,419,599, 6,000,736 and 6,007,121, all related to rotatable seals, all of which are incorporated herein by reference.

This invention relates to rotatable seals having an outer housing body and an inner rotor wherein the body and rotor have aligned bores for locking a cable to the seal by relative rotation of the rotor to the body.

U.S. Pat. No. 5,180,200 ('200) discloses a rotatable seal having an arrangement for axially locking the rotor to the housing bore and for rotationally locking the rotor after it is rotated to secure a wire to the rotor. The wire is inserted in the device bores and the rotor is axially secured in a first position where the wire is wrapped about the rotor. The rotor is then axially displace to a second position where engaged teeth rotatably lock the rotor to the housing. A tool may be required to displace the rotor to the second axial position. The wire is inserted in a direction normal to the rotor rotation axis.

U.S. Pat. No. 5,419,599 ('599) discloses a rotor that is also locked axially to the housing bore in two positions. However, the rotor has wire receiving slots rather than circular bores so that the rotor can be axially displaced to a second axial position with the wire inserted in the rotor. Ratchet teeth and pawls permit the rotor to be relatively rotated to the housing in one direction after the rotor is fully axially inserted in the housing bore with the wire in place. No tools are required to insert the rotor to the second position as in the above described seal.

U.S. Pat. No. 6,000,736 ('736) discloses a rotatable seal with a slot in the housing outer bores so the bores communicate. This permits the wire to be partially wrapped about the rotor to secure one wire end to the rotor. The other end can later be inserted into the housing and into a second bore in the rotor without being blocked by the partially wrapped wire. The rotor and housing include a ratchet and pawl mechanism for locking the rotor rotational in one direction relative to the housing.

U.S. Pat. No. 6,007,121 discloses a rotatable seal wherein unlike the seals in the above patents, the wire to be secured is inserted in a direction parallel to the rotor rotation axis rather than normal to that axis. In this structure the wire is twisted about itself or a post in the housing chamber about the rotational axis. Further, the rotor has a weakening groove adjacent to an outer surface of the rotor such that the central portion of the rotor will fracture if the wire is pulled with excessive force in a withdrawal direction along the rotor axis. Fracturing the rotor makes it unusable and provides tampering evidence.

In the seals of the of the '200, '599 and '736 patents, the wires are all inserted in a direction normal to the rotor axis. As the rotor is rotated the wires wrap about the rotor. Where one wire is inserted first to be locked to the rotor and then later an end user inserts the free end into the remaining seal bore to lock the free end to the rotor, a problem arises whereas the first wire end when wrapped may block the rotor bores preventing or resisting insertion of the free end into a rotor bore. At times, the rotor may be wound several times causing several wraps of wire about the rotor. This may completely block the remaining rotor bore preventing the free end from being engaged with the rotor and being locked.

The present inventors recognize a need to optimize the seal structure so that it is easily used at all times by a user.

A security seal according to one aspect of the present invention that solves the above problems comprises a filament and a housing defining a chamber having an axis, at least one opening is through the housing in communication with the chamber, first and second portions of the filament being received in the at least one opening normal to the axis and for securing the seal to an article. A rotor is in the chamber and has at least one bore and is rotatable about the axis, the at least one bore being aligned with the at least one opening, the rotor and housing chamber forming a filament receiving chamber, third and fourth portions of the filament being received in the at least one bore, the rotor including a rib for forming the filament receiving chamber into at least one sub-chamber, the rib for guiding the received filament into the at least one sub-chamber. One way motion means permit the rotor to be relatively rotated with respect to the housing in only one direction about the axis for wrapping the received filament about the rotor in the at least one sub-chamber to secure the received filament to the rotor and housing.

In a further aspect, the at least one bore and at least one opening lie in a plane, the plane defining upper and a lower rotor sections, the rib being located in the plane.

In a further aspect, the rotor at least one bore lies in a plane defining rotor upper and lower sections, the housing and rotor including complementary locking means for axially locking the lower section to the housing in the chamber, the rib being located in the plane.

The rib preferably comprises a V-shaped member but may have an external surface that is arcuate.

In a further aspect, the at least one opening comprises first and second openings lying in a plane, the at least one bore comprising third and fourth bores lying in the plane, the rib lying in the plane.

The rib thus guides the filament as it is being wrapped about the rotor into the sub-chambers out of the way of the rotor bores so that the filament free end can be later inserted into a rotor bore and locked to the rotor by rotation of the rotor. The rotor bores are not blocked when an end of the filament is initially wrapped about the rotor wherein the free end of the filament may later be attached to the rotor without interference from, the initial wrapped state of the filament.

IN THE DRAWING

Figure 1:
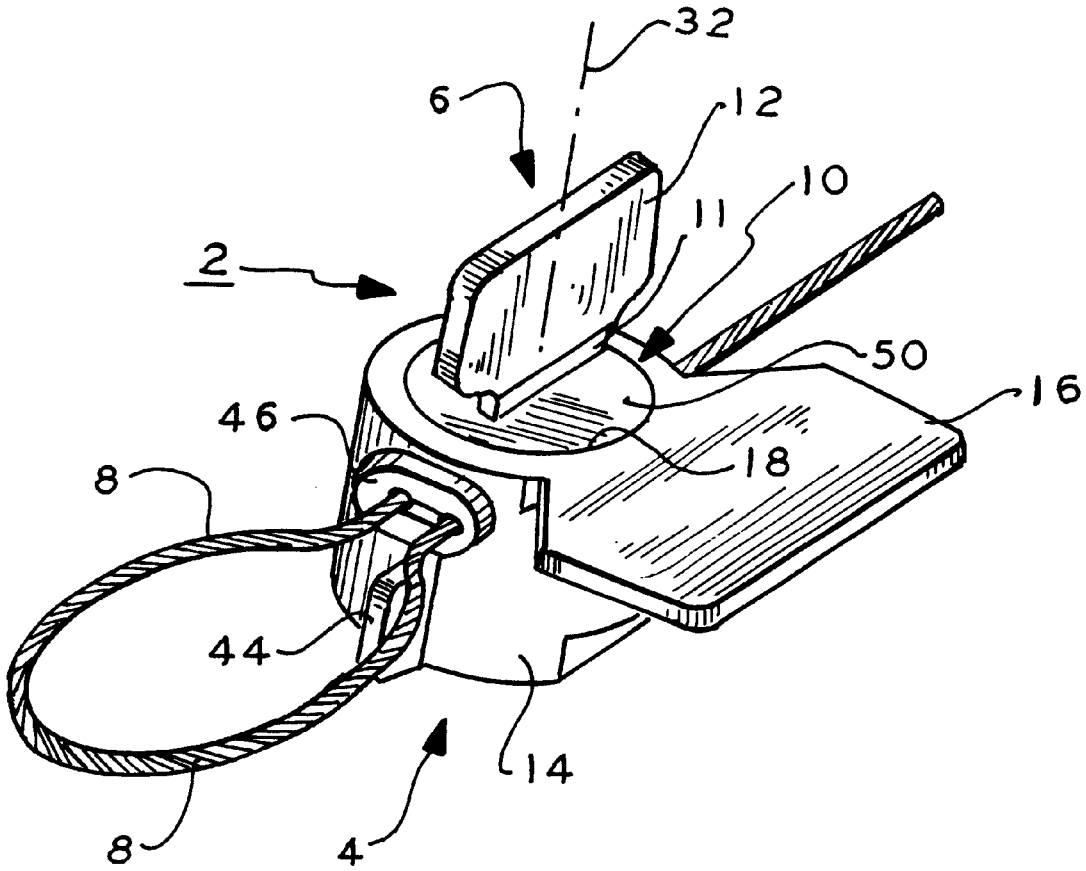
FIG. 1 is an isometric view of a rotatable seal rotor according to an embodiment of the present invention.
Figure 2A:
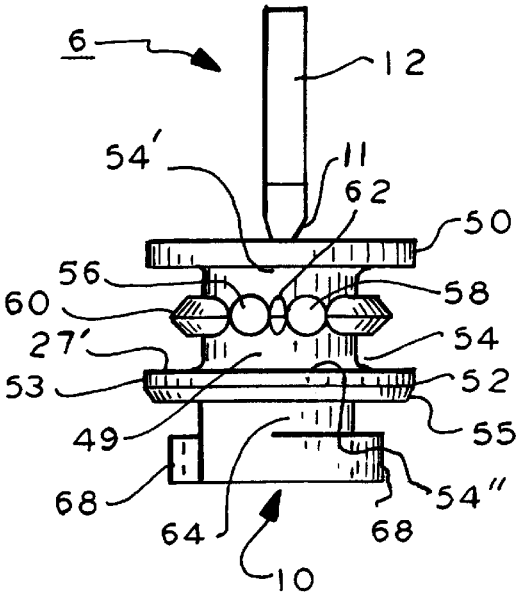
FIG. 2 is an isometric view of the rotor of the seal of FIG. 1.
Figure 2B:
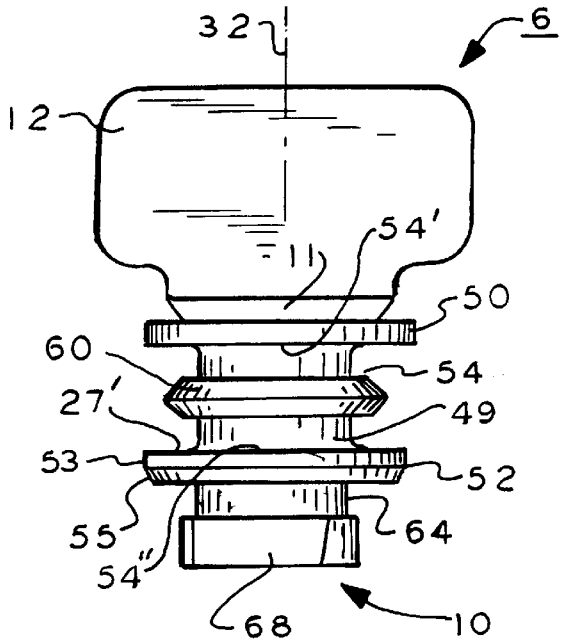
Figure 2C:
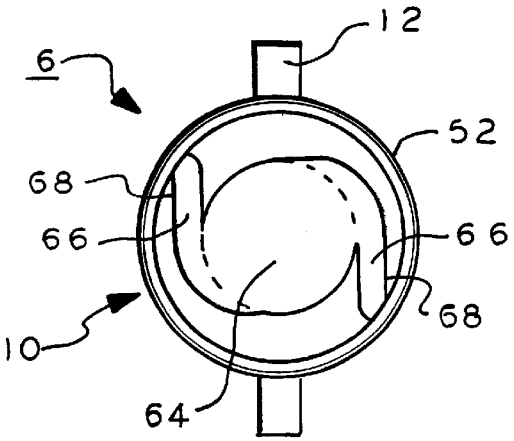
Figure 2:
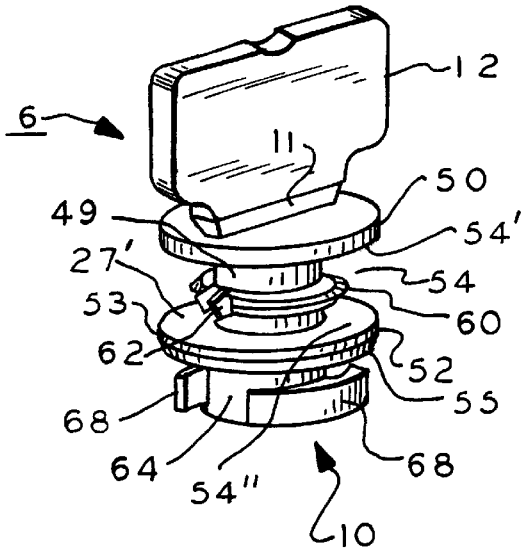
Figure 3A:
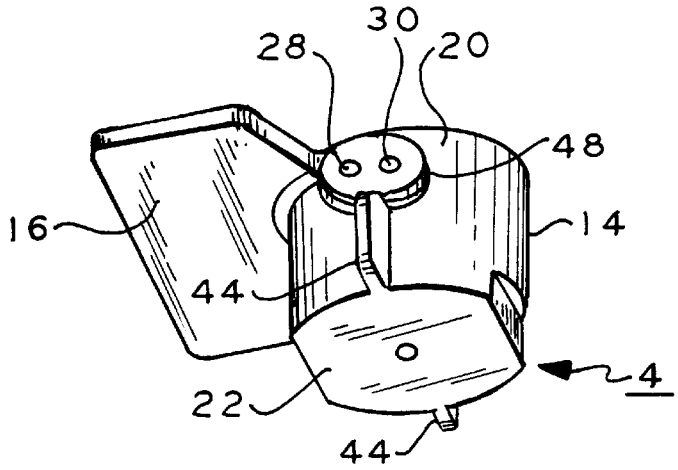
Figure 3B:
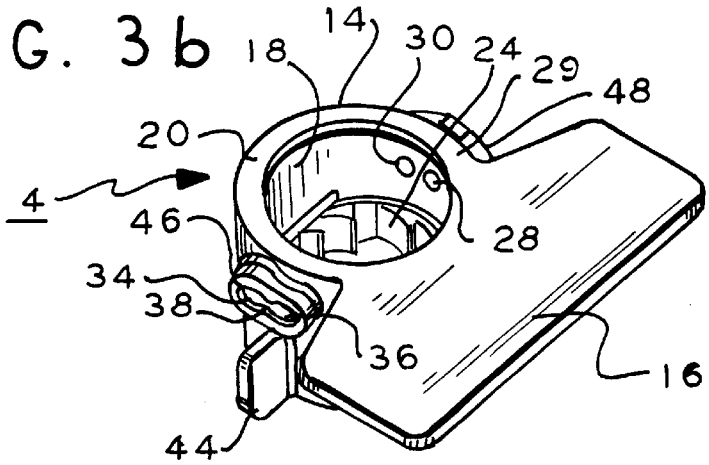

FIGS. 2*a*, 2*b* and 2*c* are respective side, front elevation and bottom plan views of the rotor of FIG. 2;

FIGS. 3*a* and 3*b* are respective isometric top and bottom views of the housing of the seal of FIG. 1 wherein the view of FIG. 3*a* is rotated approximately 180° relative to the view of FIG. 3*b;*

Figure 4:
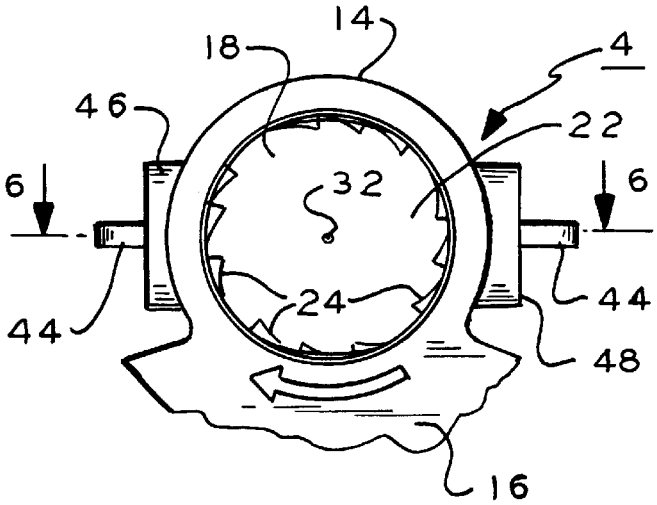

FIG. 4 is a top plan view of the housing of FIGS. 3*a* and 3*b;*

Figure 5:
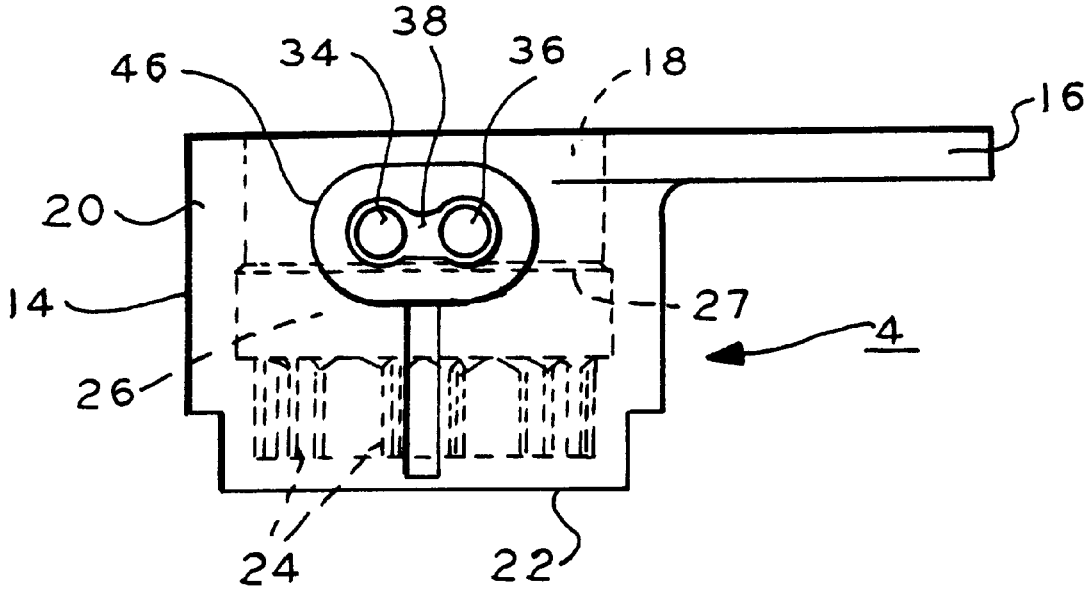

FIG. 5 is a side elevation view of the housing of FIGS. 3*a* and 3*b;*

Figure 6:
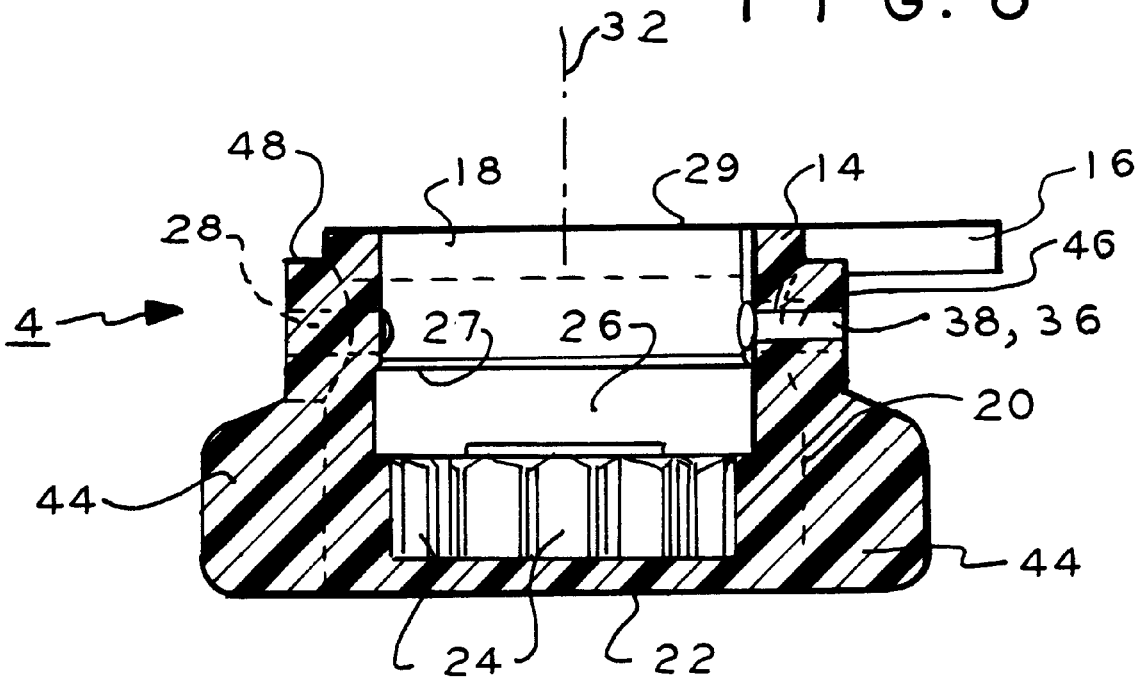
Figure 7:
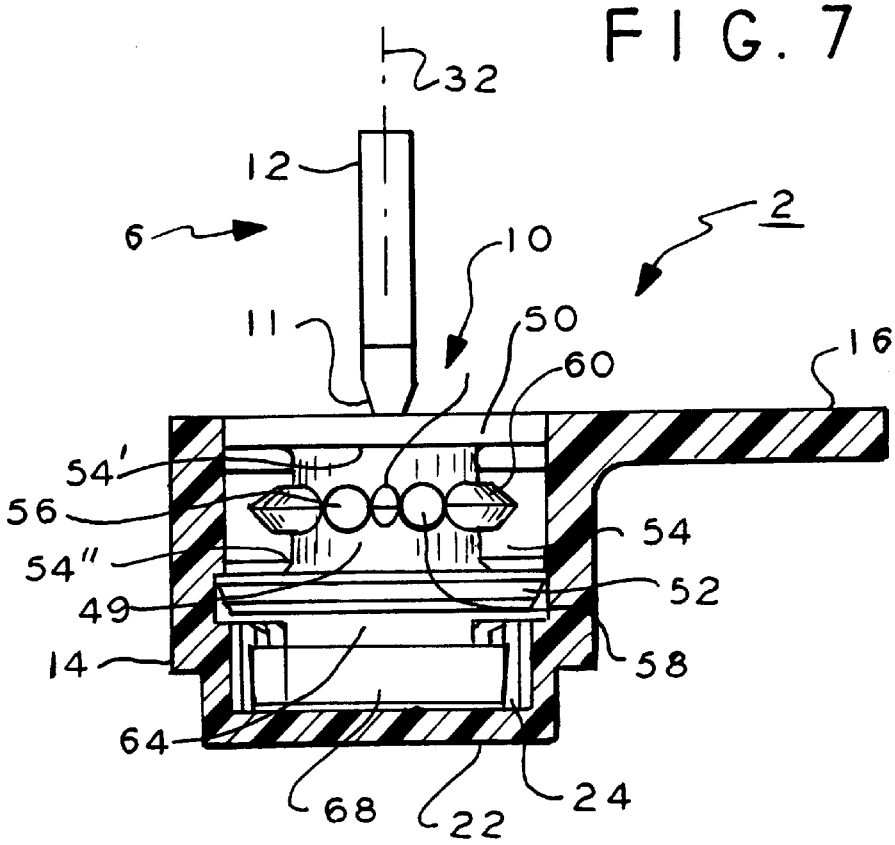
Figure 8:
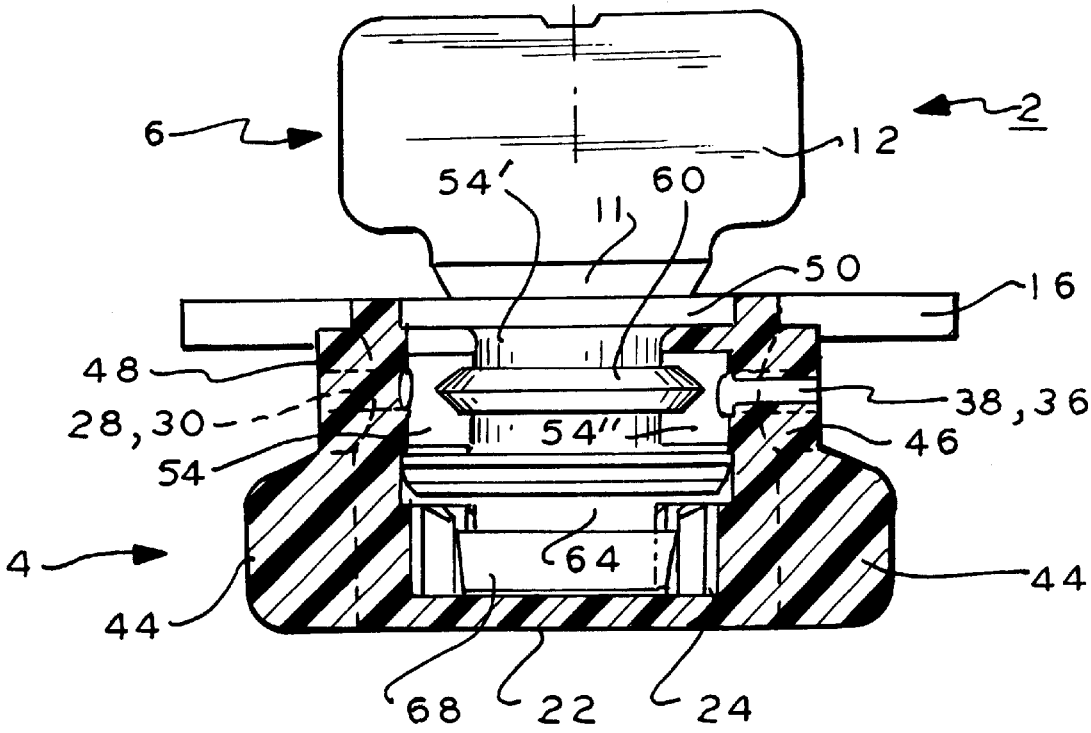
Figure 9:
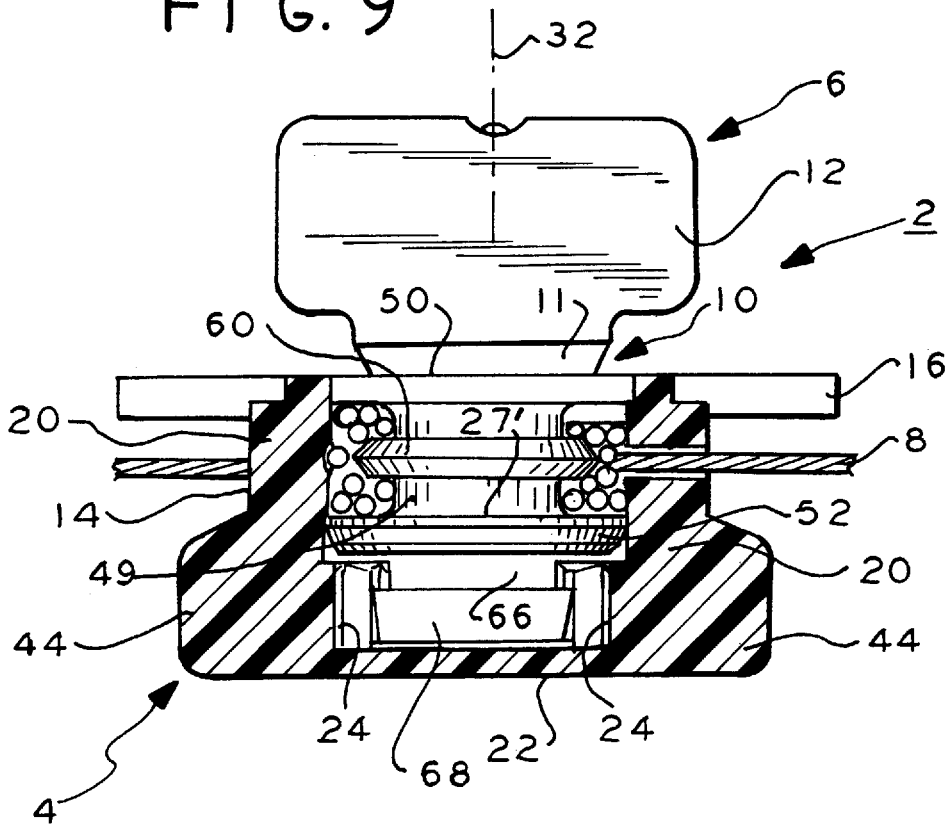
Figure 10:
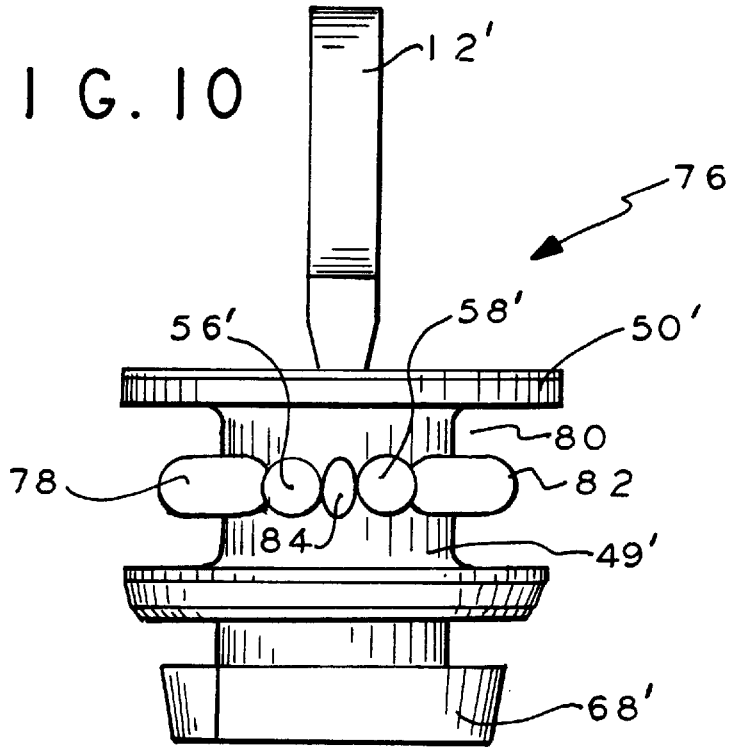

FIG. 6 is a sectional elevation view of the housing of the housing of FIG. 4 taken along lines 6—6;

FIGS. 7 and 8 are orthogonal side elevation partially in section views of the seal of the present invention with the rotor assembled to the housing;

FIG. 9 is a sectional elevation view of the seal similar to that of FIG. 8 with a locking filament attached to the seal; and FIG. 10 is a side elevation view of a rotor according to a further embodiment of the present invention.

DETAILED DESCRIPTION OF THE INVENTION

In FIG. 1, rotatable seal 2 includes a female housing 4, a male rotor 6, and a flexible locking filament 8, preferably stranded wire or a thermoplastic monofilament size-on-size. The term filament is intended to include monofilaments of thermoplastic material, solid wire or solid strands of non-metallic material and stranded metal wire cables. The drawing figures illustrate the filament 8 as a stranded wire cable by way of example.

The term "size-on-size" refers to the diameter of the filament as having a dimension that is variable in value from a maximum dimension (zero upward tolerance) to a minimum dimension or negative tolerance range. For example, a 0.010 inch (0.254 mm) size-on-size monofilament has a maximum diameter of 0.010+0.0 inches and a minimum value that may be 0.010–xxx inches. The stranded wire filament 8 is preferably about 0.030 inches (0.76 mm) in diameter in this embodiment. The monofilament is preferably 0.010 inches in diameter. The housing 4 and rotor 6 are both preferably molded frangible thermoplastic, but may be other materials.

The rotor 6, which may be acrylic, includes a rotor body 10 and a manually operated finger gripped flange 12. The flange 12 is used to rotate the rotor 6 relative to the housing 4. The flange 12 is connected to the rotor body 10 by a reduced tapered section 11 forming a frangible weakening region. This permits the flange 12 to be broken free of the body 10 in case of excessive force is used to remove the rotor 6 from the housing 4 chamber 18 (FIG. 4) in the axial direction of axis 32 and provides tamper evidence.

The housing 4, FIGS. 3*a*, 3*b*, 4–6, which may be acrylic, preferably has a generally circular cylindrical hollow body 14 and a radially outwardly extending planar flag 16 whose plane is normal to axis 32. The housing 4 exterior may be any desired shape. The housing body 14 has a generally cylindrical chamber 18 in which the rotor body 10 is rotatably seated and which rotates about axis 32 of the chamber 18.

The housing 4 has a generally circular cylindrical side wall 20 enclosing circular in cross-section chamber 18 which is closed at one end by a base 22. Formed in the wall 20 and in the base 22 at their junction projecting into chamber 18 are a plurality of circumferential spaced ratchet teeth 24. The teeth 24 each have a gradual trailing rake and a steep leading rake as disclosed more fully in the aforementioned U.S. Pat. No. 6,000,736 incorporated by reference herein. The depth of the teeth 24 (the radial depth of rake 24*b* from central axis 32) is not critical, and the function of the teeth is described in more detail in U.S. Pat. No. 6,000,736.

In FIGS. 5 and 6, an circular cylindrical channel 26 is formed in the interior of the wall 20 medially along the axis 32 next adjacent to the teeth 24 in the chamber 18. The channel 26 has a shoulder 27 at the junction with the smaller internal diameter of the chamber 18 adjacent to the open end 29 of the chamber. Formed through the wall 20 next adjacent to and above the channel 26 at shoulder 27 is a pair of through openings or bores 28, 30 (FIG. 3*a*). The bores 28 and 30 are of like diameter, preferably 0.062 inches (1.6 mm) for use with a stranded wire filament of about 0.030 inch diameter. The bores 28 and 30 lie in a plane parallel to the planar base 22 normal to the chamber 18 central axis 32 (FIG. 6).

Formed through the wall 20 above the channel 26 at shoulder 27 is a second pair of bores 34, 36, FIGS. 5 and 6, lying on the same plane as bores 28, 30. The bores 34 and 36 are of like diameter as the bores 28, 30 and are aligned with the respective ones of bores 28, 30 and lie in a plane normal to the axis 32. The bores 34 and 36 are interconnected by a slot 38, the slot having a width dimension parallel to the axis 32 of about 0.035 inches (0.9 mm). The slot 38 width closely receives the filament but is smaller than the bore diameters to minimize entry of tampering tools into the chamber 18.

The bores 28 and 34 are aligned with each other and parallel to the alignment of the bores 30 and 36 which also are aligned with each other. The bores 34 and 36 and slot 38 together form a slotted through-bore in the wall 20. The bore pairs 28, 34 and 30, 36 are preferably mutually parallel and parallel to the base 22 and are coplanar. Those skilled in the art will appreciate that other arrangements are possible. For example, the slot 38 and bores 28, 34 may comprise a single width slot or a relatively enlarged bore for the purpose to be described below, notwithstanding a minimum size opening is desired to minimize entry of tampering tools into the chamber 18.

The housing 4 includes diametrically opposite radially outwardly extending flanges 44 on the external side of wall 20. The flanges 44 and 12 are employed to provide leverage for rotating the rotor 6 relative to the housing 4. Cowls 46 and 48 are integrally formed with the wall 20 on opposite sides thereof. The cowls 48 and 46 contain continuations of the bores 28, 30 and 34, 36 and slot 38, respectively. The cowls serve to lengthen these bores to limit access to the chamber 18 by tampering tools. The flanges 44 and cowls 46 and 48 may be omitted.

In FIGS. 2, 2*a*, 2*b* and 2*c*, rotor 6 has a generally circular cylindrical body 10 which has various portions of different transverse diametrical dimensions and shapes. The rotor 6 includes a circular cylindrical head 50 which is disc shaped. Flange 12, which is sheet-like, extends upwardly from the head 50 from weakened section 11 and is molded one piece therewith.

Circular disc-like member 52 is spaced from the head 50 by annular channel 54 formed by a central circular cylindrical body portion 49. The member 52 has two sections 53 and 55. Section 53 is circular cylindrical and section 55 is frusto-conical. Head 50 has an external diameter substantially equal to that of the chamber 18 internal diameter, FIGS. 7 and 8.

The head 50 and member 52 are spaced from each other a distance to provide a channel 54 width parallel to axis 32. This width is sufficient to permit at least two abutting filament 8 portions to be wrapped about the rotor in the channel 54 in a direction parallel to the axis 32. The channel also has a radial depth in a direction normal to the axis 32 sufficient for at least two layers of filament 8 portions to be wrapped thereabout. For example, with a filament diameter of about 0.030 inches (0.8 mm), the channel 54 preferably has a width of about 0.082 inches (2 mm) and a radial depth of about 0.100 inches (2.5 mm). These dimensions are sufficient to accommodate overlying layers of filament 8 portions radially and axially providing a cross section volume that is at least quadruple that of the filament.

A pair of through-bores 56 and 58, FIGS. 2 and 9, are formed in the body 10 circular cylindrical body portion 49 in the channel 54. The portion 49 is between the head 50 and member 52 and forms the base of the channel 54. The bores 56 and 58 are preferably the same diameter as the bores 28, 30, 34 and 36 in the housing 4, e.g., 0.065 inches (1.6 mm). The bores 56 and 58 align with the housing bores in a plane normal to the axis 32, FIG. 8, in one angular orientation of the rotor 6 about axis 32 of the housing 4, the axis 32 defining the axis of rotation of the rotor 6 relative to the housing 4.

An annular rib 60 extends radially outwardly from the body portion 49 centrally between the head 50 and the member 52. The rib 60 is discontinuous at bores 56 and 58 which pass through the rib 60. The rib 60 also has a segment 62 between the bores 56 and 58. A segment 62 is on diametrical opposite sides of the body portion 49. The rib 60 has a V-shaped cross section with the apex of the V distal the body portion 49. The rib divides the channel 54 into two subchannels 54' and 54" axially below and above the rib along axis 32. The rib 60 terminates within the channel 54 so that the subchannels 54' and 54" are in communication with each other in the outer radial portion of the region juxtaposed by head 50 and member 52.

In the alternative, in FIG. 10, rotor 76 has a rib 78 in channel 80. The rotor 76 including the channel 80, except for the shape of the rib 78, is otherwise the same as rotor 6 and channel 54 of the embodiment of FIG. 2. The rib 78 has a semi-circular outer peripheral surface 82. The rib 78 is divided into sections by through bores 56' and 58'. Section 84 is between the two bores 56' and 58' on each diametrical opposite side of the rotor 76. The reference numerals in FIG. 10 which are primed represent identical structure of the rotor 6 of FIG. 4 with the same unprimed reference numerals.

In FIGS. 2, 2*a*–2*c*, the rotor 6 has a further circular cylindrical body portion 64 depending from member 52. A pair of pawl teeth 68, FIG. 2*c*, extend radially outwardly from the body portion 64 distal the member below the member 52 at the bottom of the rotor 6. The teeth 68 are identical and radially project spiral-like from the body portion 64 and are radially flexible. Each tooth 68 comprise an arm 66 that extend in a tangential direction relative to the circular surface of the body 64 in a plane. The teeth 68 extend in opposite directions from the body portion 64 parallel to each other. The end tips of the teeth 68 are V-shaped and have a first tip portion that generally extends in a tangential direction relative to axis 32 and a second tip portion that extends radially from axis 32.

Because of the cantilevered arms 66, the teeth 68 are radially flexible in the plane in which they lie. The teeth 68 radially resiliently flex when rotated in engagement with the ratchet teeth 24 of the housing 4. The teeth 68 mate with the ratchet teeth 24 and serve as pawls relative to the ratchet teeth 24.

When the spiral-like teeth 68 are aligned coplanar with ratchet teeth 24, FIGS. 7 and 8, the rotor 6 can only rotate in one angular direction about the axis 32 due to the engagement of the pawl teeth 68 with the ratchet teeth 24. As the rotor 6 rotates, the teeth 68 flex radially inwardly in a plane permitting relative rotation of the rotor. Normally, the quiescent state of teeth 68 is such that teeth 68 lock in engagement with teeth 24, preventing reverse rotation as occurs in a typical ratchet and pawl action.

As the rotor 6 rotates, the pawl teeth 68 ride up the ramp formed by teeth 24 rake and flex radially inwardly. The teeth 68 then snap return radially outwardly when in root regions of the teeth 24 in this relative position.

The rotor 6 is fully inserted axially into the chamber 18 to the axial position shown in FIGS. 7 and 8. The member 52 and its shoulder 27 are snapped into the channel 26 of the housing chamber 18. The diametric differences between the member 52, the smaller diameter chamber 18 adjacent to the flange 16 and the larger chamber 18 diameter in the channel 26 is such that the rotor 6 is easily rotated within the chamber 18 relative to the housing 22, but is also locked axially in chamber 18 along axis 32 by the engagement of the housing chamber 18 shoulder 27, FIG. 6, with the shoulder 27' of the rotor member 52, FIGS. 2*a*, 2*b*.

The teeth 68 are complementary to the teeth 24 in the chamber 18, the teeth having sufficient clearance so that upon insertion the teeth 24 and 68 are aligned coplanar and engaged. This engagement may be provided by simultaneous rotation of the rotor 6 relative to the housing 4 during axial insertion of the rotor into chamber 18. The teeth 68 taper slightly radially inwardly in a direction toward axis 32 and toward the rotor bottom wall, FIG. 2*a*, to assist in insertion of the rotor 6 into engagement with the teeth 24, FIG. 7.

When the rotor 6 is fully inserted into the housing 4 and the member 52 is seated and locked in the channel 26, the teeth 24 and 68 mesh and permit relative rotation of the housing 4 and the rotor 6 in only one direction about axis 32. When the rotor 6 is inserted into the chamber 18, FIG. 8, the bores 56 and 58 of the rotor (FIGS. 7 and 8) are aligned with the corresponding respective bores 30, 36 and 28, 34 of the housing 4. The rotor 6 may be rotated to align the bores. Alignment devices (not shown) may be provided as shown in the aforementioned commonly owned patents to assist in aligning the rotor bores to the housing 4 bores if desired.

In operation, FIG. 9, after the rotor 6 is assembled to the housing 4, FIGS. 7 and 8, a filament 8 end is inserted in one set of the aligned housing and rotor bores such as bore 36 (housing bore, FIG. 3*b*) and bore 58 of the rotor. Note that in FIG. 1, the orientation of the flange 12 shows the alignment of the bores of the rotor to the housing bores. The plane of the flange 12 bisects the plane medially of the two sets of housing bores, as illustrated in FIG. 1. One end of the filament is inserted into the one housing and one rotor bores. The rotor is then rotated to lock that end to the rotor by wrapping the filament about the rotor body portion 49, FIG. 9 (this wrapping state being shown partially for clarity of illustration).

In FIG. 9, the filament 8 is shown with both ends fully wrapped about the rotor in channel 54 in the chamber 18, in the article lock state, it being understood that partially wrapping of one end of the filament 8 (in the shipping state of the seal) to the rotor entails fewer turns of the rotor and filament, e.g., about 1or 2 turns. As the rotor 6 is rotated, the filament 8 between the rotor and the housing in the channel 54 portion of the chamber 18 is guided by the rib 60 into either of the subchannels 54' or 54" of the chamber 18 as shown and which form sub-chambers. Since the rib 60 distal end is within the channel 54 of the chamber 18, the sub-channels 54' and 54" in the chamber 18 communicate with each other and the filament portion that exits the rotor bore can be shifted to either of the sub-chambers 54' and 54". The filament 8 as the rotor is rotated is guided by the V-shape of the rib (or arcuate shape of FIG. 10) into either of the chamber 18 subchannels 54' and 54" which form sub-chambers. The result is that when the filament is initially locked to the rotor at one end thereof, no turns of the filament are aligned with the rotor and housing bores. This insures these bores remain clear for receiving the filament 8 other free end at the time it is desired to lock the filament to an article and to the seal.

When it is desired to secure the seal to an article to be sealed, the filament 8 is attached to the article and its free end is inserted into the unused one of the housing bores 34 or 36. In the above description, the initial filament end was secured via housing bore 36 and rotor bore 58. In this case the free end is inserted into housing bore 34 and rotor bore 56. In FIG. 9, since the partially wrapped filament at one end thereof is wrapped about the rotor in either of subchannels 54' or 54", it does not block the bores 34 and 56 of the respective housing and rotor. In this way the free filament end can be inserted into the seal without an impediment as might otherwise occur without the rib 60. The flange 12 is then used to rotate the rotor 6 relative to the housing 4 to wrap the filament free end about the rotor in the channel 54.

This further wrapping results in numerous turns wrapped about the rotor as shown in FIG. 9 wherein 9 total turns are shown wrapped. One or more turns may also at this time be in the same plane as the housing and rotor bores because the seal is now in the fully sealed state and blockage of the bores is not an issue at this time since the filament is in the desired bores as applicable. The filament may also be passed through the rotor and through the housing in the aligned bores as shown in FIG. 9, with the central portion of the filament free end secured to and wrapped about the rotor. If desired both ends of the filament may be secured to the seal simultaneously.

While the present invention has been described with regard to certain embodiments, it should be understood that variations and modifications will be obvious to those skilled in the art without departing from the scope of the present invention as defined in the appended claims. For example, the guide rib may be of any shape and may be in any location in the rotor aligned with the rotor bores. The rib 60 may in the alternative be formed into discontinuous sections that function as a single rib.

What is claimed is:

1. A security seal comprising:

a filament;

a housing defining a chamber having an axis, at least one opening through the housing in communication with the chamber, first and second portions of the filament being received in the at least one opening normal to the axis and for securing the seal to an article;

a rotor in the chamber having at least one bore and rotatable about the axis, the at least one bore being aligned with the at least one opening, the rotor and housing chamber forming a filament receiving chamber, third and fourth portions of the filament being received in the at least one bore, the rotor including a rib for forming the filament receiving chamber into two sub-chambers, the rib being aligned with the rotor at least one bore for guiding the received filament into the two sub-chambers; and one way motion means for permitting the rotor to be relatively rotated with respect to the housing in only one direction about the axis for wrapping the received filament about the rotor in the at least one sub-chamber to secure the received filament to the rotor and housing.

2. The seal of claim 1 wherein the at least one bore and at least one opening lie in a plane, the plane defining upper and a lower rotor sections, the rib being located in the plane.

3. The seal of claim 1 wherein the rotor at least one bore lies in a plane defining rotor upper and lower sections, the housing and rotor including complementary locking means for axially locking the lower section to the housing in the chamber, the rib being located in the plane.

4. The seal of claim 1 wherein the rib comprises a V-shaped member.

5. The seal of claim 1 wherein the rib has an external surface that is arcuate.

6. The seal of claim 1 wherein the at least one opening comprises first and second openings lying in a plane, the at least one bore comprising first and second bores lying in said plane, said rib lying in said plane.

7. The seal of claim 6 wherein the housing has third and fourth openings on a side of the housing opposite the first and second openings.

8. The seal of claim 1 wherein the rib comprises discontinuous segments of an annular rib, the segments forming extensions of said at least one bore and lie in a plane normal to said axis.

9. The seal of claim 2 wherein the rib comprises a plurality of segments forming a discontinuous annular rib, said at least one bore and said at least one opening being coplanar with the rib.

10. A security seal comprising:

a filament;

a housing defining a chamber having an open top and a closed bottom and an axis, at least one opening through the housing in communication with the chamber, first and second portions of the filament being received in the at least one opening normal to the axis and for securing the seal to an article;

a rotor in the chamber having at least one bore and rotatable about the axis, the at least one bore being aligned with the at least one opening, third and fourth portions of said filament being received in the at least one bore, the rotor having at least one rib in the plane of the at least one opening and in the plane of the at least one bore for dividing the chamber into a plurality of sub-chambers;

locking means for axially locking the rotor to the housing; and one way motion means for permitting the rotor to be relatively rotated with respect to the housing in only one direction about the axis for wrapping the received filament about the rotor in at least one of the sub-chambers to secure the received filament to the rotor and housing.

11. A security seal comprising:

a filament;

a housing defining a chamber having an axis, at least one opening through the housing in communication with the chamber, first and second portions of the filament being received in the at least one opening normal to the axis and for securing the seal to an article;

a rotor in the chamber having at least one bore and rotatable about the axis, the at least one bore being aligned with the at least one opening, the rotor and housing chamber forming a filament receiving chamber, third and fourth portions of the filament being received in the at least one bore, the rotor including a rib comprising discontinuous segments of an annular rib, the segments forming extensions of said at least one bore and lying in a plane normal to said axis for forming the filament receiving chamber into at least one sub-chamber, the rib for guiding the received filament into the at least one sub-chamber; and one way motion means for permitting the rotor to be relatively rotated with respect to the housing in only one direction about the axis for wrapping the received filament about the rotor in the at least one sub-chamber to secure the received filament to the rotor and housing.

12. A security seal comprising:

a filament;

a housing defining a chamber having an axis, at least one opening through the housing in communication with the chamber, first and second portions of the filament being received in the at least one opening normal to the axis and for securing the seal to an article;

a rotor in the chamber having at least one bore and rotatable about the axis, the at least one bore being aligned with the at least one opening, the rotor and housing chamber forming a filament receiving chamber, third and fourth portions of the filament being received in the at least one bore, the rotor including a rib for forming the filament receiving chamber into at least one sub-chamber, the rib for guiding the received filament into the at least one sub-chamber; and one way motion means for permitting the rotor to be relatively rotated with respect to the housing in only one direction about the axis for wrapping the received filament about the rotor in the at least one sub-chamber to secure the received filament to the rotor and housing;

the rib, the at least one bore and the at least one opening lying in a plane, the plane defining upper and a lower rotor sections;

the rib comprising a plurality of segments forming a discontinuous annular rib.

* * * * *